US006310591B1

(12) United States Patent
Morgan et al.

(10) Patent No.: US 6,310,591 B1
(45) Date of Patent: Oct. 30, 2001

(54) SPATIAL-TEMPORAL MULTIPLEXING FOR HIGH BIT-DEPTH RESOLUTION DISPLAYS

(75) Inventors: Daniel J. Morgan, Denton; Gregory S. Pettitt, Rowlett; Donald B. Doherty, Richardson, all of TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/370,419

(22) Filed: Aug. 9, 1999

Related U.S. Application Data

(60) Provisional application No. 60/096,925, filed on Aug. 18, 1998.

(51) Int. Cl.[7] ..... G09G 3/34

(52) U.S. Cl. ..... 345/84; 348/771

(58) Field of Search ..... 345/84, 147, 148, 345/88, 89, 87, 30, 55; 348/771, 760, 761, 755, 753

(56) References Cited

U.S. PATENT DOCUMENTS

| | | | | |
|---|---|---|---|---|
| 5,668,611 | * | 9/1997 | Blaxtan | 345/84 |
| 5,686,939 | * | 11/1997 | Millward et al. | 345/148 |
| 5,777,589 | * | 7/1998 | Gale | 345/84 |

FOREIGN PATENT DOCUMENTS

| | | |
|---|---|---|
| 0 364 307 A2 | 4/1990 | (EP) . |
| 0 526 045 A2 | 2/1993 | (EP) . |
| 0 686 954 A1 | 12/1995 | (EP) . |
| 0 848 369 A2 | 6/1998 | (EP) . |

* cited by examiner

*Primary Examiner*—Chanh Nguyen
(74) *Attorney, Agent, or Firm*—Charles A. Brill; Wade James Brady, III; Frederick J. Telecky, Jr.

(57) ABSTRACT

A method and apparatus for spatially and temporally multiplexing display data. The use of this method results in a bit-depth resolution higher than that achievable by the system given a number of bits of resolution. The method includes the steps of determining the desired perceived resolution (26), establishing the number of bit-planes to be used to achieve that perceived resolution (28), using at least one of those bit-planes for spatial-temporal least significant bit values (STMLSBs) (30), referencing the developed values of the STMLSBs to fractional bit gray code levels (32), developing spatial patterns (34), determining whether the spatial patterns will start in a predetermined sequence or randomly from frame-to-frame (36), loading the data onto the modulator and displaying it (38). The apparatus includes a random number generator (48) and a look up table (50) to enable the choice between random and predetermined spatial patterns, and pattern logic (46), which produces the pattern to be used.

5 Claims, 6 Drawing Sheets

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| | | | | | | | | | | | | | | | | | | | | | | | | | | | | | | | |

| | | | FRAME NUMBER 1 | | | | | | | | | | | FRAME NUMBER 2 | | | | | |
|---|---|---|---|---|---|---|---|---|---|---|---|---|---|---|---|---|---|---|---|
| COL/LINE | C0 | C1 | C2 | C3 | C4 | C5 | C6 | C7 | C8 | | COL/LINE | C0 | C1 | C2 | C3 | C4 | C5 | C6 | C7 | C8 |
| L0 | P25s | CK | P25 | CK | P25 | CK | P25 | CK | P25 | | L0 | CK | P25s | CK | P25 | CK | P25 | CK | P25 | CK |
| L1 | CK | | CK | | CK | | CK | | CK | | L1 | | CK | | CK | | CK | | CK | |
| L2 | P25 | CK | P25 | CK | P25 | CK | P25 | CK | P25 | | L2 | CK | P25 | CK | P25 | CK | P25 | CK | P25 | CK |
| L3 | CK | | CK | | CK | | CK | | CK | | L3 | | CK | | CK | | CK | | CK | |
| L4 | P25 | CK | P25 | CK | P25 | CK | P25 | CK | P25 | | L4 | CK | P25 | CK | P25 | CK | P25 | CK | P25 | CK |
| L5 | CK | | CK | | CK | | CK | | CK | | L5 | | CK | | CK | | CK | | CK | |
| L6 | P25 | CK | P25 | CK | P25 | CK | P25 | CK | P25 | | L6 | CK | P25 | CK | P25 | CK | P25 | CK | P25 | CK |
| L7 | CK | | CK | | CK | | CK | | CK | | L7 | | CK | | CK | | CK | | CK | |
| L8 | P25 | CK | P25 | CK | P25 | CK | P25 | CK | P25 | | L8 | CK | P25 | CK | P25 | CK | P25 | CK | P25 | CK |

*FIG. 4*

| COL/LINE | C0 | C1 | C2 | C3 | C4 | C5 | C6 | C7 | C8 |
|---|---|---|---|---|---|---|---|---|---|
| L0 | P12s | CK | | CK | P12 | CK | | CK | P12 |
| L1 | CK | | CK | | CK | | CK | | CK |
| L2 | | CK | P12 | CK | | CK | P12 | CK | |
| L3 | CK | | CK | | CK | | CK | | CK |
| L4 | P12 | CK | | CK | P12 | CK | | CK | P12 |
| L5 | CK | | CK | | CK | | CK | | CK |
| L6 | | CK | P12 | CK | | CK | P12 | CK | |
| L7 | CK | | CK | | CK | | CK | | CK |
| L8 | P12 | CK | | CK | P12 | CK | | CK | P12 |

| COL/LINE | C0 | C1 | C2 | C3 | C4 | C5 | C6 | C7 | C8 |
|---|---|---|---|---|---|---|---|---|---|
| L0 | CK | P12s | CK | | CK | P12 | CK | | CK |
| L1 | | CK | | CK | | CK | | CK | |
| L2 | CK | | CK | P12 | CK | | CK | P12 | CK |
| L3 | | CK | | CK | | CK | | CK | |
| L4 | CK | P12 | CK | | CK | P12 | CK | | CK |
| L5 | | CK | | CK | | CK | | CK | |
| L6 | CK | | CK | P12 | CK | | CK | P12 | CK |
| L7 | | CK | | CK | | CK | | CK | |
| L8 | CK | P12 | CK | | CK | P12 | CK | | CK |

*FIG. 5*

SPATIAL-TEMPORAL MULTIPLEXING FOR HIGH BIT-DEPTH RESOLUTION DISPLAYS

This application claims priority under 35 USC § 119(e) (1) of provisional application No. 60/096,925 filed Aug. 18, 1998.

BACKGROUND OF THE INVENTION

1. Field of the Invention

This invention relates to spatial light modulator display systems, more particularly to addressing schemes for these systems.

2. Background of the Invention

Spatial light modulator display systems typically include a spatial light modulator comprised of an x-y array of individually controllable elements that are used to modulate picture elements (pixels) of an image. Examples of these modulators include Digital Micromirror Devices™ (DMD™), Actuated Mirror Arrays™, liquid crystal cells, grating light valves, and plasma display panels. Some of these examples operated in an analog fashion, where the amount of light transferred to any pixel is determined by how far the corresponding cell moves, or how much light is allowed through that cell. Others operate digitally, where the cell either transfers light to the image or not.

The digital mode of operation raises unique problems since the human eye has an analog response. This analog response requires that the digital cells use a technique called pulse-width modulation (PWM); In PWM techniques, the display signal undergoes digital sampling, resulting in a predetermined number of samples, each having the same number of bits. These bits are then used to address the individual cell in for time periods proportional to the bits' significance (i.e., the most significant bit receives the most time to display its data). Systems with a higher number of bits per sample provide better images.

Addressing the cells typically involves transferring the data for a given bit to the activation circuitry for a cell, causing the cell to respond to that data, then illuminating the cell to modulate the light in the manner required by that bit of data. The tasks of storing, transferring, activating and illuminating the cells must be repeated several times in a relatively short time to achieve high quality images. A typical display system operates at 60 Hz, so each frame of data has only 1/60 of a second (16.7 milliseconds) in which to be displayed. In a sequential color system, where the modulator is illuminated with each of the three colors, red, green and blue, in sequence, each color receives one-third of that time (5.57 milliseconds).

In current spatial light modulator display systems, the largest number of bits achievable in a sequential color system is typically 8 bits. Eight bits of data must divide the 5.57 milliseconds up between them, with the most significant bit receiving approximately one-half that time (2.79 milliseconds), and the least significant bit receiving roughly one-two hundred fifty fifth of that time (20 microseconds). The cells must have a switching time fast enough to display the data for the least significant bit (LSB) in 20 microseconds to achieve 8-bits of resolution. Higher numbers of bits require even faster switching speeds.

For larger display systems, such as digital cinema, resolution higher than 8 bits is necessary to achieve film quality images with spatial light modulator displays. In some examples, such as the DMD™, 10 bits can be achieved. Therefore, for digital cinema quality images, a method is needed that will allow spatial light modulators to display more than 10 bits of resolution without requiring an increase in switching speed.

SUMMARY OF THE INVENTION

One aspect of the invention is a method to spatially and temporally multiplex display data to achieve a higher bit-depth resolution. Generally, the invention includes the steps of determining the desired perceived resolution, establishing the number of bit-planes to be used to achieve that perceived resolution, using at least one of those bit-planes for spatial-temporal least significant bit values (STMLSBs), referencing the developed values of the STMLSBs to a bit weighting, developing spatial patterns, determining whether the spatial patterns will spatially start in each frame in a predetermined sequence or randomly, loading the data onto the modulator and displaying it.

In one embodiment of the invention, twelve bits of perceived resolution can be achieved from only 9 bit-planes. The 9 bit-planes are established, with 2 of those being used for spatial and temporal multiplexing. In another embodiment of the invention, fourteen bits can be referenced from only twelve. The twelve bit-planes are established, with 3 bit-planes for spatial and temporal multiplexing.

The spatial multiplexing is achieved by using patterns of percentages of active pixels within a frame, such as a 50% checkerboard pattern. These patterns are controlled temporally by starting the pattern spatially at a different starting point from one frame to the next. The determination of the pattern spatial start point can be either random or predetermined in each successive frame.

It is an advantage of the invention in that it allows higher bit-depth resolution to be achieved using a lower number of bits than would otherwise be necessary.

It is an advantage of the invention in that it can use LSB weightings that are non-binary, allowing longer bit on-times for LSBs and thus slower element switching speeds.

It is an advantage of the invention in that it can be used by any PWM system.

It is an advantage of the invention in that it uses fewer bit-planes, allowing more time to bit split higher order bits.

BRIEF DESCRIPTION OF THE DRAWINGS

For a more complete understanding of the present invention and for further advantages thereof, reference is now made to the following Detailed Description taken in conjunction with the accompanying Drawings in which:

FIG. 3 shows one embodiment of a 50% spatial temporal multiplexing pattern in accordance with the invention.

FIG. 4 shows one embodiment of a 25% spatial temporal multiplexing pattern in accordance with the invention.

FIG. 5 shows one embodiment of a 12.5% spatial temporal multiplexing pattern in accordance with the invention.

DETAILED DESCRIPTION OF THE PREFERRED EMBODIMENTS

Figure 1:
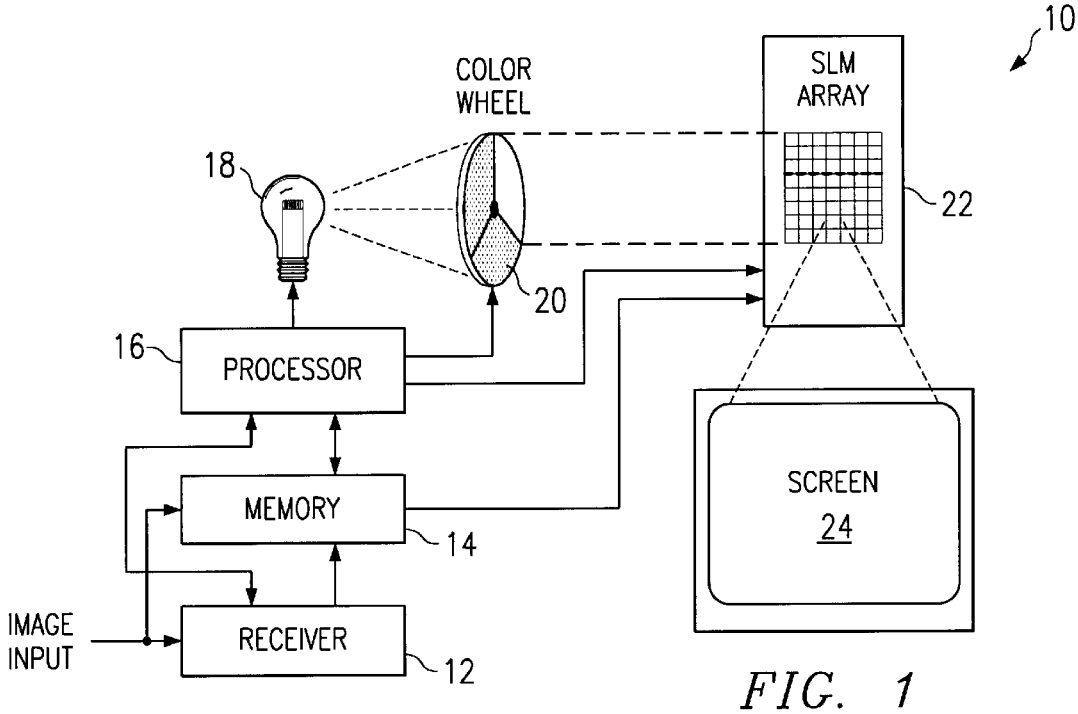
FIG. 1 shows one example of a spatial light modulator display system.

FIG. 1 shows one example of a spatial light modulator display system 10. The display data, which can be from any display source, analog, digital, video, graphics, etc., is received at receiver 12. The data is also received at memory 14, if necessary for further processing. The processor block 16 could actually comprise several processors. It performs such tasks as analog-digital conversion, if necessary, color space conversion, and any other selected processing. The processor also controls the light source 18 and the color wheel 20.

The system uses a color wheel to perform color sequencing of the light for the spatial light modulator 22. This particular embodiment is for a one spatial light modulator reflective display system. However, the techniques set forth herein are not limited to such systems, and the discussion is in no way intended to limit it as such. The only requirement of a system to use this invention is that it employs pulse-width modulation. the processor in FIG. 1 also performs the necessary bit manipulations to format the data into the correct bit-plane formats for the correct colors.

A bit-plane in this instance is a set of display data, one bit for each element on the spatial light modulator, each bit having the same significance from the digital sample for that element. For example, the data either is already digital, or is converted to digital by the processor 14. Each element on the array has a sample of 8 bits that represents its data. All of the data for all of the elements is written into memory. The data is read out of the memory such that the most significant bit (MSB) from each sample is read out together. If the MSB is bit 7, for example, the resulting bit-plane of data would be all the bit 7*s* for each element on the array. The bit itself will either be 1, representing that the element should be on for the MSB time, or 0, representing that the element should be off for the MSB time.

The times for each bit in a conventional pulse width modulation system are determined by the amount of time necessary for the least significant bit (LSB). Since the bits are in a binary system, each higher order bit will be some multiple of the LSB time. For an 8-bit system, for example, where bit 0 is the LSB, bit 1 is 2 LSBs, bit 2 is 4 LSBs, bit 3 is 8 LSBs, etc. Each element displays its data, 1 or 0, for each bit plane, which the human eye integrates into shades of gray. The addition of PWM for each color allows the eye to integrate colors as well.

Systems such as these produce color images typically in one of two ways. Color sequential systems, described above, sequence the data for each color to the device to coincide with that color illuminating the device. Another method is to provide one device for each color, and to converge the color images at the display surface. The invention as described herein can be used in either system, however, for initial discussion purposes, a color sequential system will be assumed, using one device.

In CRT systems, the phosphors on the back of the glass produce colors in response to excitation by the cathode ray. These phosphors have a non-linear response, which is compensated for in the video signal. This correction is referred to as gamma correction. Spatial light modulator systems have a linear response and therefore must remove this correction. The removal of this correction is referred to as degamma. The degamma function typically involves a look-up table (LUT) used to map the incoming gamma-corrected data to a non-gamma data value. An 8-bit source results in 256 codes input to the degamma process and 256 codes output from degamma processing. However, the degamma output codes have precision requiring more than 8-bit values. This is shown in the table below.

| 8-Bit Source In | Truncated 8-Bit Out | 12-Bit Out | 8-Bit Fractional Code |
|---|---|---|---|
| 255 | 255 | 4095 | 255.000 |
| 254 | 253 | 4060 | 252.750 |
| 253 | 251 | 4025 | 250.625 |
| 252 | 248 | 3990 | 248.500 |
| 130 | 58 | 930 | 57.875 |
| 129 | 57 | 914 | 57.000 |
| 128 | 56 | 899 | 56.000 |
| 127 | 55 | 884 | 55.000 |
| 126 | 54 | 868 | 54.125 |
| 101 | 33 | 534 | 33.250 |
| 100 | 33 | 522 | 32.500 |
| 99 | 32 | 511 | 31.750 |
| 98 | 31 | 500 | 31.125 |
| 97 | 30 | 488 | 30.375 |
| 33 | 3 | 46 | 2.875 |
| 32 | 3 | 43 | 2.625 |
| 31 | 2 | 40 | 2.500 |
| 30 | 2 | 37 | 2.250 |
| 29 | 2 | 34 | 2.125 |
| 28 | 2 | 32 | 2.000 |
| 27 | 2 | 29 | 1.875 |
| 26 | 2 | 27 | 1.625 |
| 25 | 2 | 25 | 1.500 |
| 24 | 1 | 23 | 1.375 |
| 23 | 1 | 21 | 1.250 |
| 22 | 1 | 19 | 1.125 |
| 21 | 1 | 17 | 1.000 |
| 20 | 1 | 15 | 1.000 |
| 19 | 1 | 14 | 0.875 |
| 18 | 1 | 12 | 0.750 |
| 17 | 1 | 11 | 0.625 |
| 16 | 1 | 9 | 0.625 |
| 15 | 1 | 8 | 0.500 |
| 14 | 0 | 7 | 0.375 |
| 13 | 0 | 6 | 0.375 |
| 12 | 0 | 5 | 0.250 |
| 11 | 0 | 4 | 0.250 |
| 10 | 0 | 3 | 0.250 |
| 9 | 0 | 3 | 0.125 |
| 8 | 0 | 2 | 0.125 |
| 7 | 0 | 2 | 0.125 |
| 6 | 0 | 1 | 0.125 |
| 5 | 0 | 1 | 0.000 |
| 4 | 0 | 0 | 0.000 |
| 3 | 0 | 0 | 0.000 |
| 2 | 0 | 0 | 0.000 |
| 1 | 0 | 0 | 0.000 |
| 0 | 0 | 0 | 0.000 |

As can be seen by the above table, higher bit-depth resolution is available for lower pixel codes after degamma is performed. Many more codes are available after degamma for lower code levels than for high source codes when the degamma processing output is less than twelve bits. If the number of bits of resolution shown on the spatial light modulator simply matches the number of bit from the source prior to degamma processing, then information is lost for lower codes output from the degamma processing. Higher than 8-bit resolution becomes available for lower significance codes. However, two problems arise.

First as discussed previously, most spatial light modulators do not switch quickly enough to allow more than 8–10 bits of resolution. Secondly, a problem occurs because of the nature of the PWM process. PWM assigns the most time to the higher significance bits. To avoid artifacts caused by transitions between the larger significance bits to the smaller significance bits, called temporal contouring, this time is broken up into smaller pieces for these bits.

For example, instead of bit 7 in an 8-bit system being displayed for all 128 of its LSB times in one continuous period, they are divided up into smaller periods in a process referred to as bit splitting. Achieving higher bits of resolution requires more time for loading more bit planes at the expense of the bit-splitting process.

Unless a method is used to show more bits of resolution than the source was encoded with, significant quantization errors result. The errors appear, for example, in the darker scenes where they collapse into a single light level. These artifacts are referred to as spatial contouring. One advantage of the invention lies in its ability to change the resolution of these types of scenes, avoiding the artifacts and improving image quality.

Generally, a single device system using color sequencing will show a dramatic improvement from 8 to 12 bits. Multiple device systems, since each device images for one color and therefore has more time, can typically produce 10 bits of resolution. Using 14 bits of resolution for this system improves image quality such that spatial contouring artifacts virtually disappear. Fourteen bits of resolution most closely matches the maximum resolution of the eye.

As an overview of the invention, the letter N will refer to the number of bits of the desired resolution. For example, in the one device system above, the desired resolution is 12 bits, so N=12. However, the method actually only loads Q bits planes, where Q<N. The method will employ a combination of spatial and temporal multiplexing and will be referred to in some instances as spatial-temporal multiplexing or multiplexing. The N-bit resolution is achieved in some embodiments of the invention by loading Q bit planes and then applying spatial-temporal multiplexing Y bit planes. The process is shown as a flowchart in FIG. 2.

Figure 2:
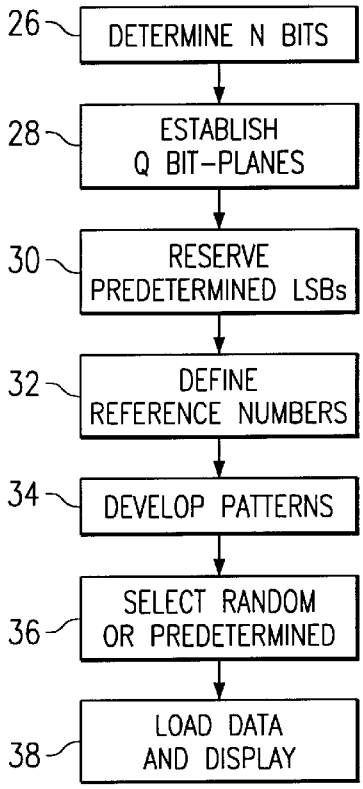
FIG. 2 shows a flowchart of a method for spatial temporal multiplexing of display data.

In step 26 of FIG. 2, the N-bits of resolution desired for display are determined. The decision will depend upon the speed of the system, the switching time of the modulator elements, the number of bit-planes available in memory, among other considerations specific to any given system. For the example to be discussed herein, N will be selected as 12. This is not intended to limit selection for a one device system to 12 bits, but will be used as a specific example for discussion purposes. In step 28, the number of bit planes, weights, and their significance will be established. For purposes of discussion, Q will be set at 9. This means that 9 bit-planes will be loaded onto the modulator.

Of that 9 bit-planes, a number of the LSBs will be reserved for the spatial-temporal multiplexing process. In this example, the reserved LSBs, Y, will be 2. Therefore, 7 bit planes (9–2) will be unaffected by the spatial-temporal process. The numerical results of these selections are shown in the below table. The Fractional Bits (FBIT) are referenced to the 8-bit LSB of the degamma output per the previous table (8-Bit Fractional Code). This is shown as step 32 in FIG. 2.

The weights of the STMLSBs (spatial-temporal multiplex LSBs) are 1.14 and 0.75 when referenced against the 8-bit LSBs. The on-times would be 17 microseconds and 11.18 microseconds, respectively. For any given pixel, FBITs less than 0.75 can be produced by turning the values of the STMLSBs on and off over a number of frames. For example, an FBIT value of 0.375 could be attained by displaying the STMLSB 0.75 in every other frame, 0.75/2=0.375.

This temporal multiplexing of the STMLSBs forms new grayscale codes. For a given pixel, none, either, or both STMLSBs can be used. For example, showing both STMLSBs in one frame and then not in the next produces the code (1.14+0.75)/2=0.945. One problem with using only the temporal multiplexing occurs in smaller FBITs. The lower FBIT values have correspondingly low update rates. For example, FBIT=0.0469 (0.75/16), the update rate is 3.75 Hz. This will cause noticeable flicker each time the STMLSB is used if a large area of the display screen contains FBIT=0.0469, degrading the image quality even though the resolution has been increased.

To overcome this problem, spatial multiplexing is also employed. Spatial multiplexing takes the form of patterns, shown in step 34 of FIG. 2. Each STMLSB is applied to each pixel out-of-phase in time, on a frame-by-frame basis, relative to neighboring pixels on the modulator. Within any given frame, the STMLSB is evenly dispersed over the screen area for a particular FBIT code during a frame.

The selection of patterns is virtually unlimited. The patterns that have achieved the best results thus far are shown in FIGS. 3–5. For each pattern, the starting point of the upper left-most active pixel is varied from frame to frame. Thus, the spatial patterns are temporally multiplexed from frame to frame in a complex manner.

The basic patterns are active pixel densities of 50%, 25% and 12.5%. A 50% pattern is shown in FIG. 3. A pixel having the label 'CKs', as opposed to 'CK', designates the upper left-most pixel where the pattern starts. Each CK indicates the occurrence of an STMLSB, where all CK in any pattern are the same STMLSB for a given pair of frames.

This checkerboard pattern is spatially dense, so no spatial artifacts are seen within one frame. For any given pixel, four of its neighbors update in each frame, and half the total screen is updated, preventing the viewer from perceiving any flicker. The checkerboard pattern is spatially in phase with any other active STMLSB. 50% of all pixels in each frame are reserved for this checkerboard, even if no STMLSBs are actively using the checkerboard in that frame. This will be seen in further patterns as the CK pixels.

FIG. 4 shows a 25% pattern. The P25*s* pixel, the start of the pattern, is randomly assigned each frame, for one active STMLSB. Two limitation are applied to its assignment, it must be a non-CK pixel (non checkerboard) and it must be in column 0, line 0 (C0/L0), CO/L1, C1/L0, or C1/L1. For two active STMLSBs, the lowest weighted one is assigned as above. The highest weighted one is simply placed in the pattern with the opposite spatial phase in each frame provided that it is still out of phase with the checkerboard.

FIG. 5 shows a 12.5% pattern, which has the same first restriction as the P25*s* pixel. However, the P12*s* pixel can be randomly assigned within the locations of C0/L0, C0/L1, C1/L0, C1/L1, C2/L0, C2/L1, C3/L0, or C3/L1. It also must be in phase with the 25% pattern, regardless of whether the 25% pattern is active or not. The same spatial phase relationships apply for two active STMLSBs as did in the 25% pattern.

As indicated above, it is possible to combine the patterns for different percentages of the different STMLSBs to achieve several different patterns. In fact, the same overall active pixel percentage can be obtained by combining various patterns as shown by the following table, which uses 1 STMLSB. Use of more then one STMLSB could allow combinations of the patterns to expanse the possible fractional bits.

| Active pixels | Source of pattern |
|---|---|
| 12.5 | 12.5 |
| 25 | 12.5 + 12.5<br>25 |
| 37.5 | 12.5 + 25 |

-continued

| Active pixels | Source of pattern |
|---|---|
| 50 | 25 + 25 |
| | 50 |
| 62.5 | 12.5 + 50 |
| | 12.5 + 25 + 25 |
| 75 | 25 + 50 |
| 87.5 | 12.5 + 25 + 50 |
| 100 | 100 |

The application of these patterns to the previous example is shown in the following table

| 8-Bit | 12-Bit | 8-bit FBIT | S-T MUX | STMLSB1 | STMLSB2 | S-T Pat (1) | S-T Pat (2) |
|---|---|---|---|---|---|---|---|
| | 35 | *2.1875* | *2.1875* | | 0.7500 | | 0.25 |
| | 34 | *2.1250* | *2.0938* | | 0.7500 | | 0.125 |
| | 33 | *2.0625* | *2.0469* | | 0.7500 | | 0.0625 |
| 2 | 32 | *2.0000* | *2.0000* | 2.000 | | 1 | |
| | 31 | *1.9375* | *1.8900* | 1.1400 | 0.7500 | 1 | 1 |
| | 30 | *1.8750* | *1.8666* | 1.1400 | 0.7500 | 1 | 0.96875 |
| | 29 | *1.8125* | *1.8197* | 1.1400 | 0.7500 | 1 | 0.90625 |
| | 28 | *1.7500* | *1.7494* | 1.1400 | 0.7500 | 1 | 0.8125 |
| | 27 | *1.6875* | *1.7025* | 1.1400 | 0.7500 | 1 | 0.75 |
| | 26 | *1.6250* | *1.6538* | 1.1400 | 0.7500 | 0.875 | 0.875 |
| | 25 | *1.5625* | *1.6050* | 1.1400 | 0.7500 | 0.75 | 1 |
| | 24 | *1.5000* | *1.5150* | 1.1400 | 0.7500 | 1 | 0.5 |
| | 23 | *1.4375* | *1.4663* | 1.1400 | 0.7500 | 0.875 | 0.625 |
| | 22 | *1.3750* | *1.3688* | 1.1400 | 0.7500 | 0.625 | 0.875 |
| | 21 | *1.3125* | *1.3200* | 1.1400 | 0.7500 | 0.5 | 1 |
| | 20 | *1.2500* | *1.2788* | 1.1400 | 0.7500 | 0.875 | 0.375 |
| | 19 | *1.1875* | *1.1813* | 1.1400 | 0.7500 | 0.625 | 0.625 |
| | 18 | *1.1250* | *1.1400* | 1.1400 | | 1 | |
| | 17 | *1.0625* | *1.0913* | 1.1400 | 0.7500 | 0.875 | 0.125 |
| 1 | 16 | *1.0000* | *1.0425* | 1.1400 | 0.7500 | 0.75 | 0.25 |
| | 15 | *0.9375* | *0.9450* | 1.1400 | 0.7500 | 0.5 | 0.5 |
| | 14 | *0.8750* | *0.8475* | 1.1400 | 0.7500 | 0.25 | 0.75 |
| | 13 | *0.8125* | *0.7988* | 1.1400 | 0.7500 | 0.125 | 0.875 |
| | 12 | *0.7500* | *0.7500* | | 0.7500 | | 1 |
| | 11 | *0.6875* | *0.6600* | 1.1400 | 0.7500 | 0.25 | 0.5 |
| | 10 | *0.6250* | *0.6113* | 1.1400 | 0.7500 | 0.125 | 0.625 |
| | 9 | *0.5625* | *0.5700* | 1.1400 | | 0.5 | |
| | 8 | *0.5000* | *0.4725* | 1.1400 | 0.7500 | 0.25 | 0.25 |
| | 7 | *0.4375* | *0.4219* | | 0.7500 | | 0.5625 |
| | 6 | *0.3750* | *0.3750* | | 0.7500 | | 0.5 |
| | 5 | *0.3125* | *0.3281* | | 0.7500 | | 0.4375 |
| | 4 | *0.2500* | *0.2363* | 1.1400 | 0.7500 | 0.125 | 0.125 |
| | 3 | *0.1875* | *0.1875* | | 0.7500 | | 0.25 |
| | 2 | *0.1250* | *0.0938* | | 0.7500 | | 0.125 |
| | 1 | *0.0625* | *0.0469* | | 0.7500 | | 0.0625 |
| 0 | 0 | *0.0000* | *0.0000* | | | | |

Spatial-Temporal Muxing with 2 Dedicated STMLSBs

Referring back to FIG. 2, the above discussion has focused on the spatial pattern development step 34. Once the patterns have been determined, a system designer must decide on how to temporally multiplex the patterns in step 36. The temporal sequencing of spatial patterns can be predetermined, where the spatial start of the spatial multiplexing pattern repeats in a planned sequence over some number of frames. Another temporal multiplexing option allows for varying levels of random number generation to reduce temporal noise artifacts generated by use of this process. Any dithering technique such as those discussed herein will create new noise artifacts. Depending upon the system and modulator, it is typically best to use some degree of randomization of the spatial start point for the spatial multiplexing patterns in actual systems.

If randomization is used, however, some further things need to be considered. It is believed that no randomization should be used for the checkerboard pattern. The checkerboard pattern, as discussed relative FIG. 3 above, just alternates its start point in each frame. This should generate no temporal artifacts since the light energy is evenly dispersed temporally over both frames and spatially within each frame. At the start of each frame, the start point for any non-checkerboard spatial pattern for a given FBIT is randomly selected.

The consideration of predetermined temporal sequencing of the starting pixel or random starting pixels apply to all aspects of this invention. This invention applies to any use of PWM in a display system, one device or multiple devices, color sequential or not. The above discussion has centered on a one device, color sequential system. The use of this invention in a multiple device system allows even higher levels of resolution.

As mentioned previously, multiple device systems typically have more bits of resolution since they have more time per color in each frame when compared to color sequential systems. In the below example, a 10-bit reference number will be used, and the desired resolution will be 14 bits (N=14). In the below discussion, 12 bit planes of data will be used (Q=12), with 3 STMLSBs (Y=3). The STMLSBs do not fit into the normal $2^n$ pattern. For example the STMLSBs weights are 0.75, 1.00 and 1.25, with on-times of 10.5 microseconds, 14 microseconds, and 17.5 microseconds, respectively.

Using 3 STMLSBs has some advantages over using 2. Checkerboards and other symmetrical patterns with a high spatial frequency of active pixels in the pattern generate the least temporal and spatial artifacts. Higher spatial frequency patterns can be used when using 3 STMLSBs instead of 2. Temporal duced because the very symmetrical pattern makes discerning the filling in of empty space from one frame to the next very hard to see. Spatial artifacts are reduced because the density of the patterns prevents any detection of the spatial contours at a normal viewing distance from the screen.

The table below shows an example of the values used to achieve the FBIT codes for 14 bits perceived resolution. The "Bit" columns show the weights of the bit planes used for each intensity combined with the pattern shown in the corresponding "S-T Paf" columns. These are referenced to a 10-bit fractional FBIT reference.

| 10-Bit | 14-Bit | 13-Bit | 10-bit FBIT | S-T Mux | Bit (1) | Bit (2) | S-T Pat (1) | S-T Pat (2) |
|---|---|---|---|---|---|---|---|---|
| | 35 | | *2.1875* | *2.1875* | 0.750 | 2.00 | 0.25 | 1.00 |
| | 34 | 17 | *2.1250* | *2.1250* | 1.000 | 2.00 | 0.125 | 1.00 |
| | 33 | | *2.0625* | *2.0938* | 0.750 | 2.00 | 0.125 | 1.00 |
| 2 | 32 | 16 | *2.0000* | *2.0000* | 2.000 | 0.00 | 1.00 | |
| | 31 | | *1.9375* | *1.9375* | 1.000 | 1.25 | 1.00 | 0.75 |
| | 30 | 15 | *1.8750* | *1.8750* | 1.000 | 1.25 | 0.50 | 0.50 |
| | 29 | | *1.8125* | *1.8125* | 0.750 | 1.25 | 0.75 | 1.00 |
| | 28 | 14 | *1.7500* | *1.7500* | 0.750 | 1.00 | 1.00 | 1.00 |
| | 27 | | *1.6875* | *1.6875* | 0.750 | 1.25 | 1.00 | 0.75 |
| | 26 | 13 | *1.6250* | *1.6250* | 1.000 | 1.25 | 1.00 | 0.50 |
| | 25 | | *1.5625* | *1.5625* | 1.000 | 1.25 | 0.50 | 0.25 |
| | 24 | 12 | *1.5000* | *1.5000* | 0.750 | 1.25 | 0.75 | 0.75 |
| | 23 | | *1.4375* | *1.4375* | 1.000 | 1.25 | 0.50 | 0.75 |
| | 22 | 11 | *1.3750* | *1.3750* | 0.750 | 1.00 | 0.50 | 1.00 |
| | 21 | | *1.3125* | *1.3125* | 1.000 | 1.25 | 1.00 | 0.25 |
| | 20 | 10 | *1.2500* | *1.2500* | 1.250 | | 1.00 | |
| | 19 | | *1.1875* | *1.1875* | 0.750 | 1.00 | 0.25 | 1.00 |
| | 18 | 9 | *1.1250* | *1.1250* | 1.000 | 1.25 | 0.50 | 0.50 |
| | 17 | | *1.0625* | *1.0625* | 1.000 | 1.25 | 0.75 | 0.25 |
| 1 | 16 | 8 | *1.0000* | *1.0000* | 1.000 | | 1.00 | |
| | 15 | | *0.9375* | *0.9375* | 1.250 | | 0.75 | |
| | 14 | 7 | *0.8750* | *0.8750* | 0.750 | 1.00 | 0.50 | 0.50 |
| | 13 | | *0.8125* | *0.8125* | 0.750 | 1.25 | 0.25 | 0.50 |
| | 12 | 6 | *0.7500* | *0.7500* | 0.750 | | 1.00 | |
| | 11 | | *0.6875* | *0.6875* | 0.750 | 1.00 | 0.25 | 0.50 |
| | 10 | 5 | *0.6250* | *0.6250* | 1.250 | | 0.50 | |
| | 9 | | *0.5625* | *0.5625* | 1.000 | 1.25 | 0.25 | 0.25 |
| | 8 | 4 | *0.5000* | *0.5000* | 1.000 | | 0.50 | |
| | 7 | | *0.4375* | *0.4375* | 0.750 | 1.00 | 0.25 | 0.25 |
| | 6 | 3 | *0.3750* | *0.3750* | 0.750 | | 0.50 | |
| | 5 | | *0.3125* | *0.3125* | 1.250 | | 0.25 | |
| | 4 | 2 | *0.2500* | *0.2500* | 1.000 | | 0.25 | |
| | 3 | | *0.1875* | *0.1875* | 0.750 | | 0.25 | |
| | 2 | 1 | *0.1250* | *0.1250* | 1.000 | | 0.125 | |
| | 1 | | *0.0625* | *0.0938* | 0.750 | | 0.125 | |
| 0 | 0 | 0 | *0.0000* | *0.0000* | 0.000 | | 0.000 | 0.000 |

At this point it may be advisable to add a step to the process of mapping the degamma function into the STM fractional level space. Using the previous table'values, the degamma function is rounded to the nearest value which can be achieved by the STM fractional levels. An example of this rounding process is given the degamma function value, or reference number, to be represented, (relative to a 10 bit space), is 26.444444, then the upper MSBs (non-STM FBITs), would save the value 26, while the lower STM FBITs would utilize the code 0.4375 (location 7 in the above table). The entire degamma function over it's entire input range would be mapped into the STM space, mapping the reference numbers to the spatial patterns, although the mapping is not exactly 1.1. This allows for the use of non-binary increasing STM fractional levels to be used.

Referring back to FIG. 2, the remaining step is to load and display the date once all of the various values needed have been determined. This process would not be done all at once. Each new frame would have to have this process, with whichever predetermined values have been decided upon, applied to it. More than likely, this will be done somewhere in the processing flow of the system described with reference to FIG. 1.

Figure 6:
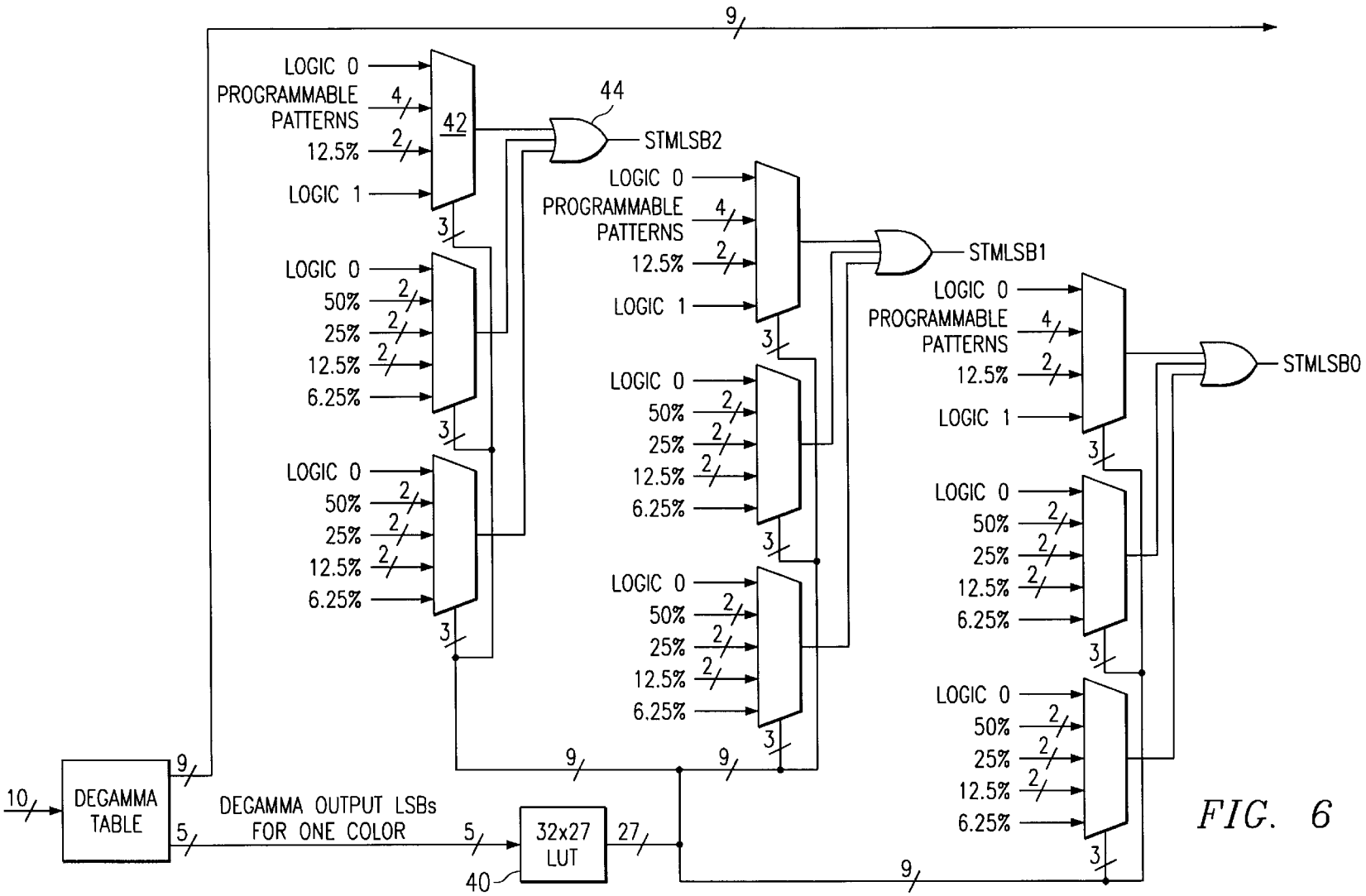
FIG. 6 shows one embodiment of a pattern selection block diagram in accordance with the invention.
Figure 7:
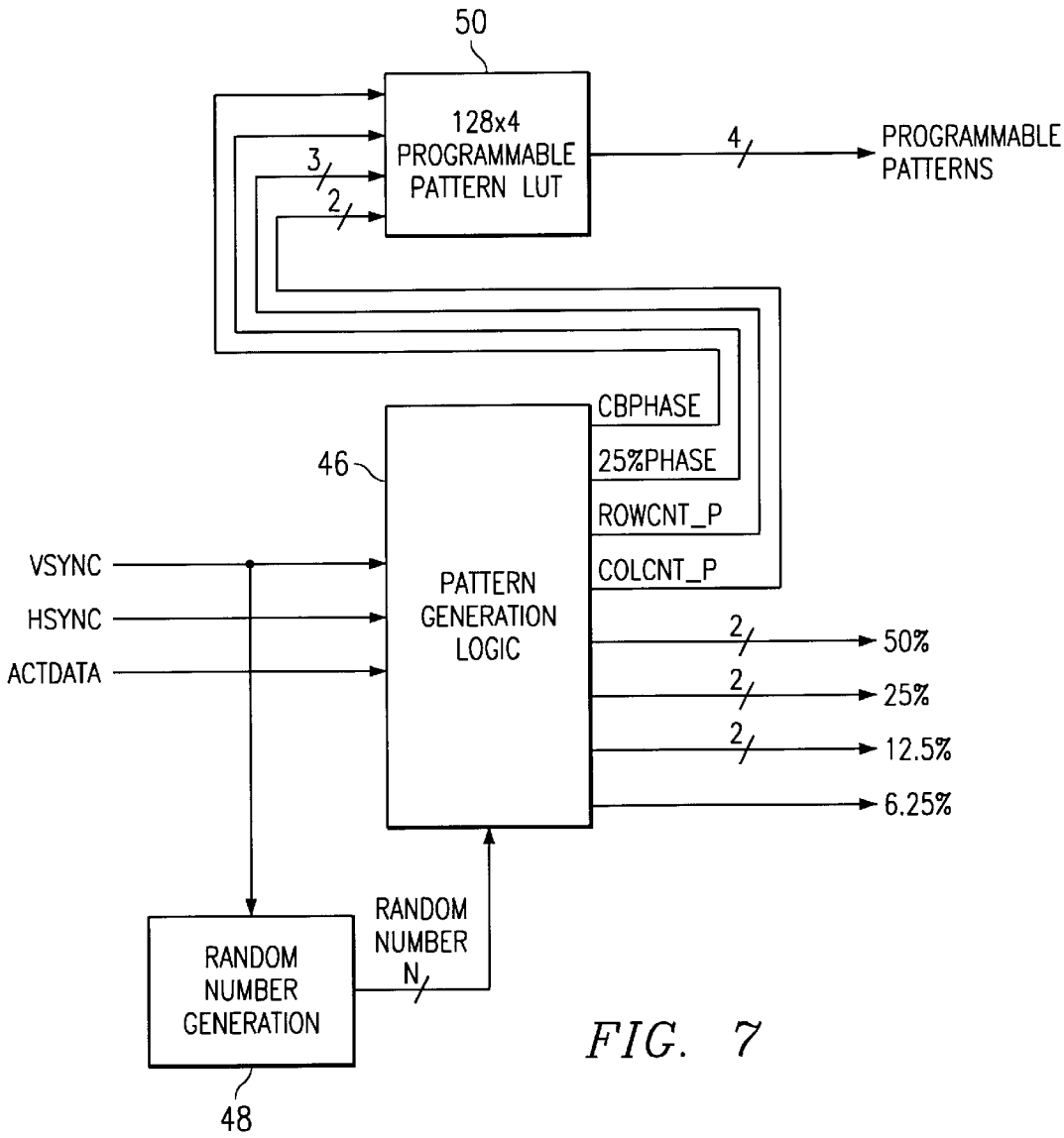
FIG. 7 shows on embodiment of a pattern signal block diagram in accordance with the invention.

FIGS. 6 and 7 show two different parts of one embodiment of this integration into the processing of the incoming video data. The embodiment shown if for a 3 device system with 3 STMLSBs. The pattern selection is based on the 5 LSBs out of the degamma table for a particular color. The multiplexes shown in FIG. 6, such as multiplexer 42, allow the needed patterns to be formed. For example, if a 75% pattern is needed for STMLSB2, then one multiplexer outputs 50% and the other outputs 25%. The OR gate 44 then combines them and outputs them as 75%.

In some instances non-symmetrical patterns are needed, such as 7/32% and 9/16%. These are generated using the programmable pattern input at multiplexer 42.

FIG. 7 shows one embodiment of circuitry to implement this type of pattern generation. The logic block 46 generates the patterns shown as an input to multiplexer 42 in FIG. 6. It received the horizontal sync (HSYNC), the vertical sync (VSYNC) and the active data (ACTDATA) signals that indicate the initiation of a row, a frame or a column, respectively. The random number generator 48 is used to produce the random pattern starting points for logic block 46 discussed above.

The logic block 46 provides signals such as those labeled 50%, 25%, etc., for multiplexer 42 and its counterparts in FIG. 7, as well as signals for the LUT 50 in FIG. 7. The LUT 50 stores 4×8 repeating patterns with four programmable phases for each pattern, which allows the use of predetermined patterns that are then programmed into the LUT 50. The VSYNC signal initiates a new random number at the start of each frame. In this way both the random start and the predetermined pattern options are enabled.

FIG. 6 also shows the degamma circuit, which can be a look up table, an adder or any other circuit that can produce 14 bits of output for 10 bits of input. In the previous example of 14 bits, 5 bits would be the LSBs used to generate the patterns, shown entering LUT 40, and 9 bits would pass directly along path 52 to the display device control circuitry not shown. The output of the functions of FIG. 6 is the STMLSBs referenced in the tables for the 3-device example shown above.

This invention allows greater bit-depth resolution than would otherwise be obtainable on spatial light modulator displays utilizing PWM. The above discussion is in no way intended to limit the systems to which it is applied. The invention can be applied to produce more or fewer FBITs than discussed above. The number of source bits can be other than 8 or 10 bits as discussed above. Similarly, the patterns used are infinite and varied, the example patterns used above are not exclusive.

Further extensions of the invention could include multiple STMLSBs other than 2 or 3. The number used can range from 1 to the number of bits in the system, restricted only by the capability of the modulator used. Additionally, when multiple STMLSBs are used, the checkerboard pattern for each STMLSB can be out of phase, rather than in phase as discussed above. Finally, the weighting of the STMLSBs can be any value that a particular application or system can support.

Thus, although there has been described to this point a particular embodiment for a method and structure for a spatially and temporally multiplexing display data to achieve higher bit-depth resolution, it is not intended that such specific references be considered as limitations upon the scope of this invention except in-so-far as set forth in the following claims.

What is claimed is:

1. A method of display high bit-depth resolution images on a spatial light modulator, comprising the steps of:

a. determining a number of bits of resolution to be displayed;

b. establishing a number of bit planes to be loaded in each frame for each color;

c. reserving a predetermined number of least significant bits (LSBs) of the number of bit planes to achieve the number of bits of resolution to be displayed;

d. defining reference numbers to provide fractional bits;

e. developing a set of spatial patterns to be used with each of said predetermined number of LSBs for each said fractional bits;

f. selecting one of either random spatial placement of the patterns or predetermined placement of the patterns to display said patterns at the start of each frame; and g. determining one of said patterns for each pixel according to said pixel's intensity.

2. The method of claim 1 wherein said selecting step selects a random placement of the patterns.

3. The method of claim 1 wherein said selecting step selects a predetermined placement of the patterns.

4. The method of claim 1 wherein said method further includes mapping said reference numbers to combinations of said spatial patterns.

5. An apparatus operable to generate patterns for high bit-depth resolution displays, comprising:

a. pattern generation logic operable to receive signals that indicate initiation of pattern generation and to generate spatially and temporally multiplexed patterns;

b. a random number generator operable to provide said pattern generation logic with a random number to indicate the spatial start of said patterns;

c. a programmable look-up table operable to store spatial phases to be selected based upon said patterns received from said pattern generation logic;

d. a circuit operable to generate fractional codes; and e. logic to select specific ones of said spatially and temporally multiplexed patterns based upon outputs from said pattern generation logic, outputs from said programmable look up table, and said fractional codes.

* * * * *